US005906049A

United States Patent [19]

Butts

[11] Patent Number: 5,906,049

[45] Date of Patent: May 25, 1999

[54] DOUBLE-ENDED UTILITY KNIFE WITH TWO COVERS

[76] Inventor: Robert Butts, 48 Princeton Ave., Gloucester, N.J. 08030

[21] Appl. No.: 09/020,825

[22] Filed: Feb. 9, 1998

[51] Int. Cl.[6] ..... B26B 5/00

[52] U.S. Cl. ..... 30/125; 30/335

[58] Field of Search ..... 30/125, 124, 162, 30/163, 335, 336

[56] References Cited

U.S. PATENT DOCUMENTS

| | | | |
|---|---|---|---|
| D. 310,474 | 9/1990 | Bartsch et al. | D8/99 |
| 4,517,741 | 5/1985 | Castelluzzo | 30/335 X |
| 4,578,865 | 4/1986 | Keller | 30/304 |
| 5,093,994 | 3/1992 | Karas | 30/125 |
| 5,337,481 | 8/1994 | Mears | 30/162 |
| 5,806,189 | 9/1998 | Bailey | 30/125 |

FOREIGN PATENT DOCUMENTS

| | | | |
|---|---|---|---|
| 2269128 | 2/1994 | United Kingdom | 30/335 |

*Primary Examiner*—Douglas D. Watts
*Attorney, Agent, or Firm*—Norman E. Lehrer

[57] ABSTRACT

A double-ended utility knife having a housing or handle including an elongated, generally rectangular base member with a first end, a second end, a front side, and a back side is disclosed. The front side of the base member has a front compartment and a cover and the back side has a back compartment with a cover where the covers are attached to the front and back sides, respectively. Each of the compartments and covers extends less than the total length of the base member and is located at opposite ends of the base member. Each cover is secured to the base member by its own screw so that only one cover need be removed in order to replace a blade. Blades extend from both ends of the housing and have their own actuator so that each blade may be extended or retracted independently of the other.

10 Claims, 2 Drawing Sheets

DOUBLE-ENDED UTILITY KNIFE WITH TWO COVERS

BACKGROUND OF THE INVENTION

The present invention is directed toward a utility knife, and more particularly toward a utility knife with a blade at both ends of the knife, where each blade may be activated independently of the other. The utility knife also has a housing with a cover on both sides of the housing where each cover may be removed independently of the other.

Typically, a utility knife has a housing which may be separable into two halves along the length of the housing so that the blade may be replaced with a new blade or a different type of blade, depending upon the user's needs.

Utility knives are also known to have two blades which are retractable. The blades may be next to each other or they may be on both ends of the knife. The knives with dual blades usually have two different blades so that two different functions may be performed, one after the other without the user having to waste time switching the blade, thereby enabling a person to work more accurately, quickly, and with minimal interruption.

The problem with these knives is that the entire housing must be disassembled in order to replace the blades. Both blades are necessarily exposed when perhaps only one blade needs to be replaced. Thus, a person is unnecessarily exposed to injury. Furthermore, one blade can be dislodged and fall out while the other blade is being replaced.

U.S. Pat. No. Des. 310,474 to Bartsch et al discloses a double-ended knife with a straight blade at one end and a hooked blade at the opposite end, each blade having its own actuator. The entire housing, however, must be dismantled in order to replace either one of the blades.

U.S. Pat. No. 5,093,994 to Karas discloses a double-ended retractable knife with a housing having two halves held together by a fastener. Both ends of the knife have a blade where one blade may be hooked and the other straight. The fastener must be removed in order to replace the blades, thereby exposing both of the blades even though both blades may not need to be replaced.

U.S. Pat. No. 4,578,865 to Keller discloses a knife with two blades parallel to each other with one actuator. The housing or handle of the knife must be separated in order to replace the blades.

U.S. Pat. No. 5,337,481 to Mears discloses a utility knife with two blades, each blade having its own actuator so that each blade may be activated independently of the other. The blades are also parallel with each other. Again, however, the entire housing must be separated in order to replace the blades.

SUMMARY OF THE INVENTION

The present invention is designed to overcome the deficiencies of the prior art discussed above. It is an object of this invention to provide a knife with a cover on each side of the knife so that only one cover need be removed in order to replace a blade.

It is another object of the invention to provide a double-ended knife with two blades where each blade may be activated independently of the other.

In accordance with the illustrative embodiments demonstrating features and advantages of the present invention, there is provided a double-ended knife which has a cover on both sides of a base member, each cover being held in place by its own screw so that only one cover need be removed in order to replace a blade. The base member and covers form the housing or handle of the knife. The knife also has a blade on both ends of the housing, each blade having its own actuator so that each blade may move independently of the other.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
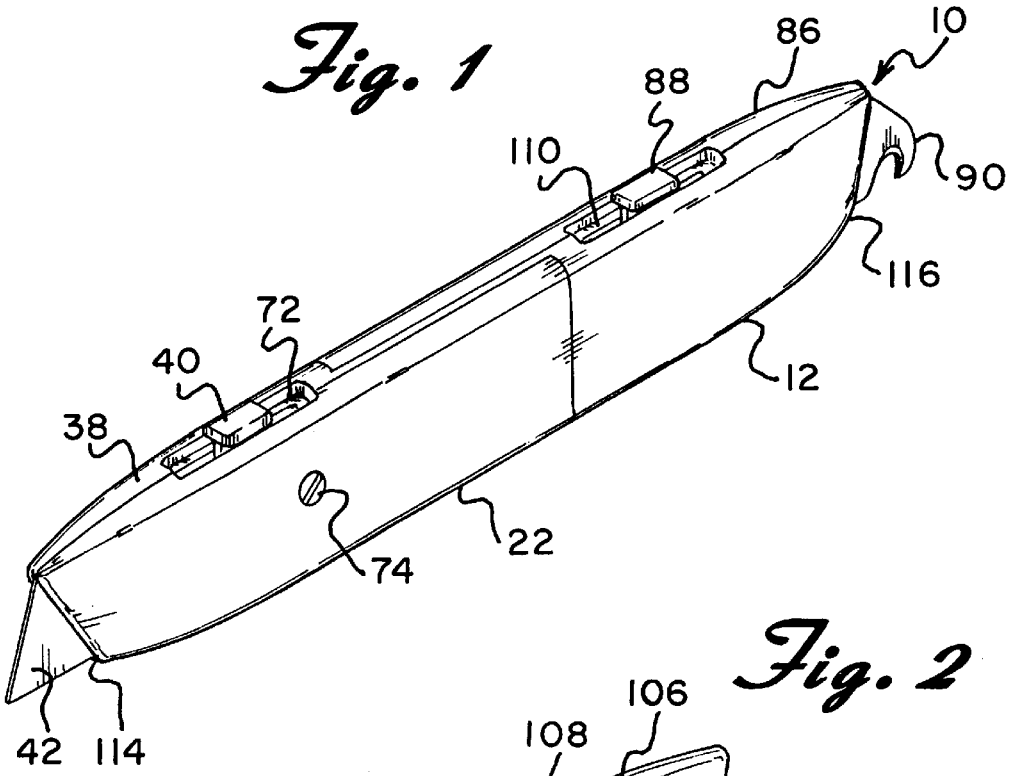
FIG. 1 is a front perspective view of the double-ended utility knife of the present invention.

Referring now to the drawings in detail wherein like reference numerals have been used throughout the various figures to designate like elements, there is shown in FIG. 1 a double-ended utility knife constructed in accordance with the principles of the present invention and designated generally as 10.

Figure 2:
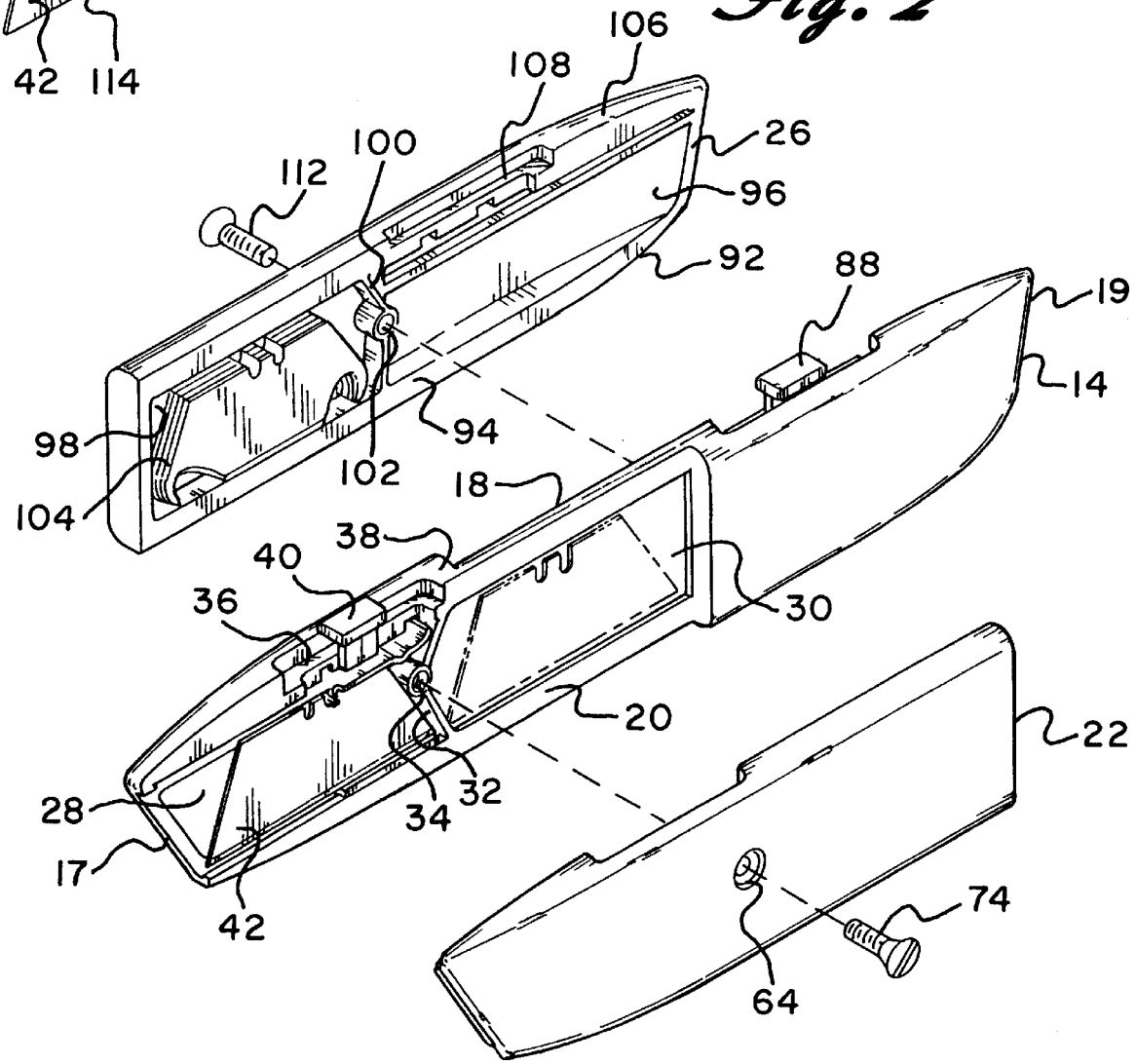
FIG. 2 is a front exploded view of the utility knife shown in FIG. 1.
Figure 4:
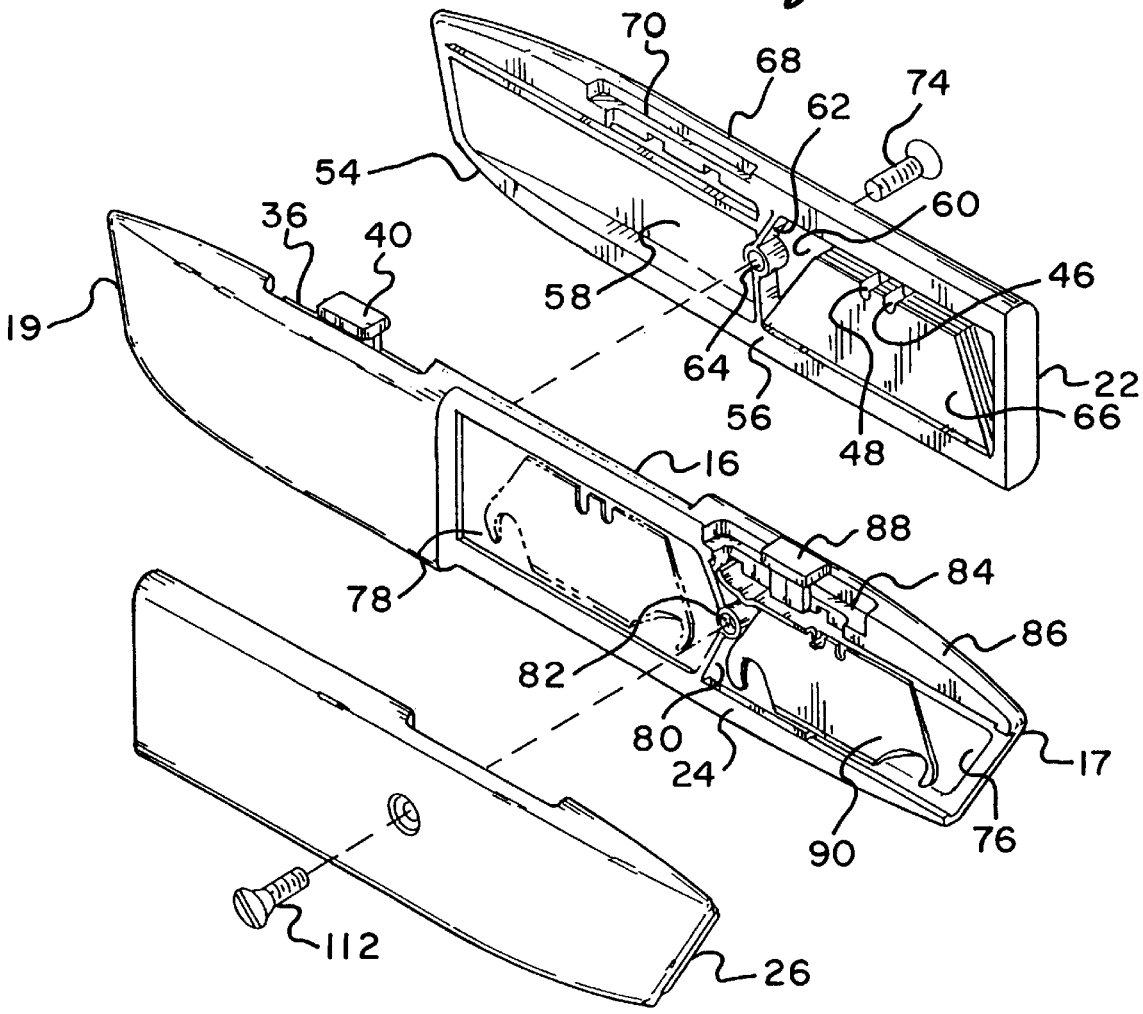
FIG. 4 is a rear mirror image view of the utility knife.

The utility knife 10 includes a housing 12 which forms the handle of the knife. The housing 12 includes an elongated, generally rectangular base member 14 with a front side 16, a back side 18, a first end 17, and a second end 19. The front side 16 has a front compartment 20 extending less than the total length of the base member 14 and which is enclosed by a front cover 22 which also extends less than the total length of the base member 14. The back side 18 has a back compartment 24 extending less than the total length of the base member 14 and which is enclosed by a back cover 26 which also extends less than the total length of the base member 14. In other words, the compartments 20 and 24 and their respective covers 22 and 26 are located on opposite sides of the base member 14 and adjacent opposite ends of the base member 14. (See FIGS. 2 and 4.)

Both sides 16 and 18 have a similar construction and will be examined in turn. First, compartment 20 is located on the front side 16 of the base member 14 and is divided into two sections 28 and 30 by a wall 32. Centrally located through the length of the wall 32 is a hole 34 which may have screw threads formed therein, the purpose of which will be discussed below. Section 28 has a cut-out portion 36 through the top edge 38 of the section 28. An actuator 40 extends through this cut-out portion 36.

Figure 3:
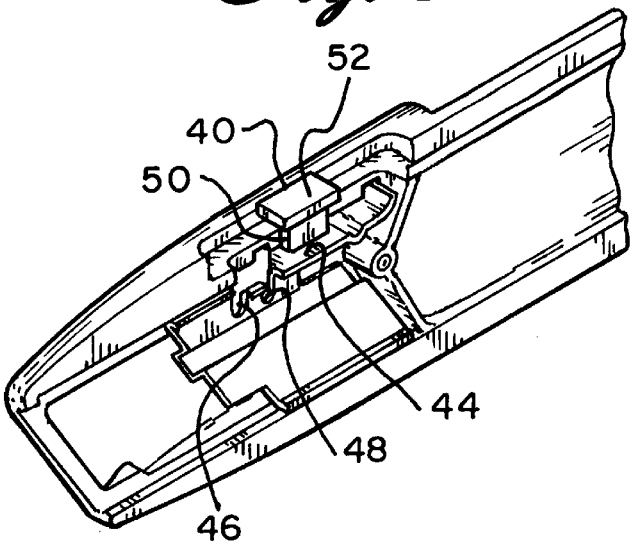
FIG. 3 is a perspective view of a portion of the inside of the housing of the utility knife.

The actuator 40 may be any type well known in the art and is removably attached to a cutting means or blade 42 in any manner known in the art. For example, the actuator 40 may have a base 44 with two projections (not shown) extending from the base 44 and into the section 28. The projections fit into grooves 46 and 48 of the blade 42 which is held by the base 44. The base 44 is attached to a member 50 within the cut-out portion 36. Extending through the cut-out portion 36 of the top of the section 28 and attached to the member 50 is a thumb pad 52 which is used to move the blade 42 into and out of this section. The user simply moves the actuator 40 across the cut-out portion 36 in order to extend or retract the blade 42. (See FIG. 3.)

The cover 22 encloses the compartment 20 and mirrors the same. That is, the inside 54 of the cover 22 also has a compartment 56 which is divided into two sections 58 and 60 by a wall 62. Centrally located through the length of the wall 62 is an aperture 64 which preferably does not have screw threads. Aperture 64, however, also extends through the width of the cover 22. (See FIG. 2.) Section 60 acts as a storage for replacement blades 66 and the top edge 68 of section 58 has a cut-out portion 70 which coincides with the cut-out portion 36 of section 28. When the cover 22 is placed over compartment 20, section 58 covers section 28 and section 60 covers section 30. In this manner, the cut-out portions 36 and 70 align and form a slot 72 through which the actuator 40 moves, thereby extending or retracting the blade 42. A screw 74 is screwed through the hole 34 and aperture 64 in order to secure or attach the cover 22 to the base member 14.

Turning now to compartment 24, it is located on the back side 18 of the base member 14, as described above. Compartment 24 is divided into two sections 76 and 78 by a wall 80 which has a hole 82 formed through the center thereof. The hole 82 may have screw threads formed therein. Section 76 has a cut-out portion 84 through the top 86 of the section and through which an actuator 88 extends. As discussed above, the actuator 88 may be any type well known in the art and is removably attached to a blade 90 in any manner known in the art. Again, the user simply moves the actuator 88 within the cut-out portion 84 in order to extend or retract the blade 90.

The cover 26 encloses and mirrors the compartment 24. That is, the inside 92 of the cover 26 has a compartment 94 which is divided into two sections 96 and 98 by a wall 100. Centrally located through the length of the wall 100 is an aperture 102 which preferably does not have screw threads. Aperture 102 extends through the width of the cover 26. (See FIG. 4.) Section 98 acts as a storage for replacement blades 104. The top edge 106 of section 96 has a cut-out portion 108 which coincides with the cut-out portion 84 of section 78. When the cover 26 is placed over compartment 24, sections 96 and 98 align with sections 76 and 78, respectively. In this manner, the cut-out portions 84 and 108 form a slot 110 through which the actuator 88 moves, thereby extending or retracting the blade 90. A screw 112 is screwed through the hole 82 and aperture 102 in order to secure the cover 26 to the base member 14.

The two blades 42 and 90 are secured to the actuators 40 and 88, respectively, as discussed above and extend outwardly from ends 114 and 116, respectively, of the knife 10. Blade 42 is shown as a straight blade and blade 90 is shown as a hooked blade. This is by way of example only, however. It should be noted that any type of blade known in the art may be used. Replacement blades may be stored within the knife in sections 60 and 98 of compartments 56 and 94, respectively. Blades are usually sold with oil on their surfaces so that they tend to stay in a stack but a blade may be easily removed by sliding it off the other blades. With the present invention the sections 60 and 98 are deep enough so that the blades being stored will not fall out when a cover is removed.

Also, it should be noted that each blade has its own actuator, therefore, each blade may be extended and retracted independently of the other. As a result, the efficiency of the worker is increased because he or she need not waste time changing a blade either by having to change knives or by having to disassemble the knife to insert a different blade. Also, risk of injury to the worker is decreased because both blades need not be exposed at the same time.

Another advantage of the present invention is that because each side of the knife has its own cover which attached to the base member independent of the other cover, only one cover need be removed at a time in order to change a blade. That is, unlike prior art devices where the entire housing needs to be disassembled in order to change a blade, with the present invention, each blade may be changed independently of the other. This is an important safety feature because only one blade is exposed at a time, thereby reducing the risk of injury to the worker and decreasing the possibility that the blades will fall out.

The present invention may be embodied in other specific forms without departing from the spirit or essential attributes thereof and accordingly, reference should be made to the appended claims rather than to the foregoing specification as indicating the scope of the invention.

I claim:

1. A double-ended utility knife comprising:

an elongated, generally rectangular base member having a first end, a second end, a front side, and a back side;

a front compartment within said front side and a back compartment within said back side;

front and back covers adapted to be attached to said front and back sides, respectively, each of said covers extending less than the total length of the said base member;

means for securing each of said covers to each of said sides; and a knife blade within each of said compartments, extendable from said first and second ends of said base member.

2. The double-ended utility knife claimed in claim 1 wherein said front cover is secured to said front side adjacent said first end of said base member and said back cover is secured to said back side adjacent said second end of said base member.

3. The double-ended utility knife claimed in claim 2 wherein said front compartment extends less than the total length of said base member and is covered by said front cover and said back compartment extends less than the total length of said base member and is covered by said back cover.

4. The double-ended utility knife claimed in claim 1 wherein said means for securing includes at least two screws.

5. The double-ended utility knife claimed in claim 1 wherein one of said blades is a hooked blade and the other of said blades is a straight blade.

6. The double-ended utility knife claimed in claim 5 further including an actuator means attached to each of said blades for extending and retracting each of said blades, independently of the other, from their respective compartments.

7. The double-ended utility knife claimed in claim 1 wherein each of said first and second covers has a compartment.

8. The double-ended utility knife claimed in claim 7 wherein each of said compartments has separating means for dividing each of said compartments into two sections.

9. The double-ended utility knife claimed in claim 8 wherein one of said sections of each of said compartments stores replacement blades.

10. The double-ended utility knife claimed in claim 1 wherein each of said front and back compartments has separating means for dividing each of said compartments into two sections.

* * * * *